US009223237B2

(12) United States Patent
Chung et al.

(10) Patent No.: US 9,223,237 B2
(45) Date of Patent: Dec. 29, 2015

(54) ADDITIVE ATTACHMENT ON TONER PARTICLES BY PLASMA

(71) Applicant: Xerox Corporation, Norwalk, CT (US)

(72) Inventors: Joo T Chung, Webster, NY (US); Steven M Malachowski, East Rochester, NY (US); Chieh-Min Cheng, Rochester, NY (US); Shigeng Li, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 128 days.

(21) Appl. No.: 14/101,345

(22) Filed: Dec. 10, 2013

(65) Prior Publication Data

US 2015/0160575 A1 Jun. 11, 2015

(51) Int. Cl.
*G03G 5/00* (2006.01)
*G03G 9/08* (2006.01)

(52) U.S. Cl.
CPC ..... *G03G 9/0815* (2013.01)

(58) Field of Classification Search
CPC ..... G03G 9/00; G03G 9/0808; G03G 9/0815
USPC ..... 430/108.1, 108.3, 108.6, 123.51, 137.1, 430/137.21
See application file for complete search history.

(56) References Cited

U.S. PATENT DOCUMENTS

2010/0092884 A1* 4/2010 Kumar et al. ..... 430/109.4
2011/0091801 A1* 4/2011 Mang et al. ..... 430/108.2

* cited by examiner

*Primary Examiner* — Thorl Chea

(57) ABSTRACT

A process for attaching additives onto toner particles using plasma is described.

19 Claims, No Drawings

ADDITIVE ATTACHMENT ON TONER PARTICLES BY PLASMA

FIELD

The disclosure relates to attachment of additives onto the surface of toner using plasma.

BACKGROUND

Industrial production of toner generally occurs through batch reaction. For example, in an emulsion/aggregation (EA) scheme, two reactors can be used, one to accommodate particle formation and aggregation and then the slurry is transferred to a second reactor to finish the product by coalescence. The residence time of the reaction mixture in either tank can be about the same, and may range up through about 8 hours or more in each reactor.

Uniform and stable additive attachment on the toner can provide suitable and stable tribo and stability to toner properties, such as flowability, over time. Additive attachment as currently practiced can be a mere blending or mixing which can result in batch to batch variation. Additives can detach over time, as well as embed into the toner particles, which can cause reduction in tribo and stability changes.

A continuous process, in conjunction with a method to improve the attachment of surface additives to toners, can provide advantages over batch aggregation and coalescence (A/C) by providing one or more of faster and/or efficient mixing, higher yield, fewer impurities, flexible A/C conditions, time and cost savings, and increased surface area to volume ratio that results in good mass and heat transfer, as well as maintain tribo values and stability of the resulting toner particles.

SUMMARY

The disclosure provides a process for additive attachment onto the toner particle surface using plasma. The plasma-mediated process can be included with a continuous process for producing an emulsion/aggregation toner, for example, in a twin screw extruder with additives attached to the toner particles by plasma treatment of the toner particles.

The process of additive attachment to toner by plasma can comprise conducting a carrier gas-toner particle mixture in a reaction tube which is in communication with a microwave resonant cavity, where the microwave resonant cavity is in microwave communication with a wave guide; generating plasma-inducing microwaves and conducing said microwaves in said wave guide to said resonant cavity; generating carrier gas plasma in the reaction tube on exposure of the gas to the microwave radiation, where the plasma is exposed to the toner particles within the reaction tube within the microwave resonant cavity; igniting the plasma, which activates the surface of the toner particles; conducting the activated toner particles to a separate section of the reaction tube; and exposing the activated toner particles to a powder cloud comprising one or more additives in the separate section, where the one or more additives attach to the surface of the activated toner particles; and exposing said toner particles carrying said additives to an elevated temperature, such as, less than about the Tg of the toner and additives that are attached to the toner surface.

Toner production can be continuous, and in that case, any known continuous process and device configuration can be used, such as, a twin screw extruder, where the extruder comprises plural ports for introducing reagents into the reactor, for example, for pH adjustment, for example, with acid or base, for example, or a freezing agent to freeze or halt further growth of aggregated particles; for monitoring the mixture within, such as, the pH or the temperature thereof, the size of particles at a site in the reactor, aggregation and coalescence, for example, and so on. The real time monitoring of the developing toner particle permits adjusting aggregation and/or coalescence (A/C) conditions to enable aggregation of toner particles, optional formation of a shell, freezing of aggregation, optionally adding surfactant or other reactants; and coalescing the particles.

Toner components are fed into a mixer and/or a homogenizer to form a toner-forming mixture. That mixture is introduced into the extruder/reactor continuously or metered at controllable rates and in controllable amounts. The pH of the mixture can be adjusted to about 4, before, at or just after introduction of the mixture into the extruder. An aggregating agent can be added in controlled amounts and fashion, and the temperature of the mixture can be raised to about 45° C. to enable aggregation. An optional resin for forming a shell is added. When the particles achieve a desired size, aggregation is halted, for example, by raising the pH to about 7.5 and then the reaction mixture temperature can be raised to about 85° C. to enable coalescence to occur. When the final particle size of, for example, about 4 μm is attained, the particles are discharged from the extruder into, for example, a heat exchanger for quenching or halting coalescence, such as, by exposure of the particles to a lowered temperature. The particles then can be separated from the liquor, for example, by pumping into a wet sieving device to remove fine and/or coarse particles, then washed and dried. The dried particles are mixed with surface additives in the plasma process as described herein.

DETAILED DESCRIPTION

In the specification and the claims that follow, singular forms such as "a," "an," and, "the," include plural forms unless the content clearly dictates otherwise.

Unless otherwise indicated, all numbers expressing quantities and conditions, and so forth used in the specification and claims are to be understood as being modified in all instances by the term, "about." "About," is meant to indicate a variation of no more than 10% from the stated value. Also used herein is the term, "equivalent," "similar," "essentially," "substantially," "approximating," or "matching," or grammatic variations thereof, which generally have acceptable definitions, or at the least, are understood to have the same meaning as, "about."

"Connection," or, "communication," or grammatic forms thereof are used herein to encompass means or devices for communicating, transporting, connecting and so on two or more devices, such as, vessels or reactors, which can be, for example, a pipe, a tube, a tubing, a hose, a conduit, a straw and so on, any device that enables the movement of a fluid therein from one device or reactor to another, such as, from one vessel to another. Thus, an example of a connecting device is a tubing, which can be made of a plastic, a metal and so on.

The terms, "standard temperature," and, "standard pressure," refer, for example, to the standard conditions used as a basis where properties vary with temperature and/or pressure. Standard temperature is 0° C.; standard pressure is 101,325 Pa or 760.0 mmHg. The term, "room temperature (RT)," refers, for example, to temperatures in a range of from about 20° C. to about 25° C.

The terms, "one or more," and, "at least one," herein mean that the description includes instances in which one of the subsequently described circumstances occurs, and that the description includes instances in which more than one of the subsequently described circumstances occurs.

"Plasma" is defined to include any portion of a gas or vapor which contains electrons, ions, free radicals, dissociated and/or excited atoms or molecules that may be produced. When sufficient energy is added to a gas, the gas becomes ionized and enters the plasma state. The plasma state may be induced by exposure to, for example, microwave radiation. A number of means for generating a plasma are known, and the instant disclosure is not limited to any one generating means. For purposes of exemplification, the disclosure hereinbelow teaches using microwaves generated by a magnetron.

The present disclosure provides a process for additive attachment onto the toner particle surface using plasma. Plasma in non-equilibrium (i.e., non-thermal plasma), a state in which the overall gas is at low temperature and only the electrons and ions are very energetic, may be used in such applications as the functionalization of surfaces and attachment of additives as disclosed herein. As all of the interactive phenomena are limited to the most external layer of the toner particle, plasma directed additive attachment does not affect the bulk properties of the toner. Thus, additives may be attached to the surface of a toner particle which is treated by the non-thermal plasma to achieve additive/toner combinations where, for example, additives do not detach over time or embed into the toner particles. Therefore, toner particles produced by the processes described herein exhibit superior properties, such as, tribo charge values and enhanced aging stability relative to toner with additives applied in a non-plasma-mediated method.

In embodiments, the excitation energy supplied to a gas to form plasma (i.e., ionized gas) may originate from electrical discharge, direct currents, radio frequencies, microwave or other forms of electromagnetic radiation (see, e.g., U.S. Pub. No. 20100006227, herein incorporated by reference in entirety). In some embodiments, the plasma may be generated using microwave energy in a waveguide. In a related aspect, the waveguide may be cylindrical or rectangular. The plasma may be generated using a microwave with a frequency of from about 1 MGHz to about 300 GHz. In embodiments, the plasma may be generated at atmospheric pressure. In one aspect, the generation of plasma may not require any heating. Plasma of interest is of a type that has high frequency electromagnetic radiation in the GHz range and is capable of exciting electrode-less gas discharges. As will be apparent to one of skill in the art, plasma discharges if the electric field at a given frequency exceeds the intrinsic breakdown field strength of the gas.

In embodiments, the plasma is generated from the gas by microwave in a microwave resonant cavity where the plasma is ignited by any of a number of means. The plasma is exposed to toner particles and activates the surface of the toner particle making the surface more reactive. The activated toner particle then passes through a subsequent portion of the tube where the plasma-activated particles are exposed to a powder cloud of one or more additives, and whereby the additives attach to a surface of the toner particles.

Toner particles of interest can be of any composition so long as amenable to surface additive adhesion by plasma. Hence, the toner can be of a polyester, a polystyrene and so on, as known in the art. The following discussion is directed to polyester EA toner, but the method and device can be used with essentially any toner chemistry.

In embodiments, suitable resins or latexes (which terms are used interchangeably herein) for forming a toner include polyester resins. Suitable polyester resins include, for example, crystalline, amorphous, combinations thereof, and the like. The polyester resins may be linear, branched, combinations thereof, and the like. Polyester resins may include, in embodiments, those resins described in U.S. Pat. Nos. 6,593,049 and 6,756,176, the disclosure of each of which hereby is incorporated by reference in entirety. Suitable resins also may include a mixture of an amorphous polyester resin and a crystalline polyester resin as described in U.S. Pat. No. 6,830,860, the disclosure of which hereby is incorporated by reference in entirety.

In embodiments, the resin may be a polyester resin formed by reacting a diol with a diacid in the presence of an optional catalyst. For forming a crystalline polyester, suitable diols include aliphatic diols with from about 2 to about 36 carbon atoms, such as, 1,2-ethanediol, 1,3-propanediol, 1,4-butanediol, 1,5-pentanediol, 1,6-hexanediol, 1,7-heptanediol and the like; alkali sulfo-aliphatic diols, such as, sodio 2-sulfo-1,2-ethanediol, lithio 2-sulfo-1,2-ethanediol, potassio 2-sulfo-1,2-ethanediol, sodio 2-sulfo-1,3-propanediol, mixtures thereof, and the like, and so on. The aliphatic diol may be, for example, selected in an amount of from about 40 to about 60 mole % (although amounts outside of those ranges may be used).

Examples of diacids or diesters including vinyl diacids or vinyl diesters, selected for the preparation of the crystalline resins include oxalic acid, succinic acid, glutaric acid, adipic acid, suberic acid, azelaic acid, sebacic acid, fumaric acid, and so on, and a diester or anhydride thereof. The diacid may be selected in an amount of, for example, in embodiments from about 40 to about 60 mole %, although amounts outside of that range can be used.

Examples of crystalline resins include polyesters, polyamides, polyimides, polyolefins, polyethylene, polybutylene, polyisobutyrate, ethylene-propylene copolymers, ethylene-vinyl acetate copolymers, polypropylene, mixtures thereof, and the like, such as poly(ethylene-adipate), poly(propylene-adipate), poly(butylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly(hexylene-succinate), poly(octylene-succinate) and so on. Examples of polyamides include poly(ethylene-adipamide), poly(propylene-adipamide), poly(butylenes-adipamide), poly(pentylene-adipamide), poly(hexylene-adipamide) and so on. Examples of polyimides include poly(ethylene-adipimide), poly(propylene-adipimide), poly(butylene-adipimide), poly (pentylene-adipimide), poly(hexylene-adipimide) and so on.

Suitable crystalline resins include those disclosed in U.S. Publ. No. 2006/0222991, the disclosure of which hereby is incorporated by reference in entirety. In embodiments, a suitable crystalline resin may be composed of ethylene glycol and a mixture of dodecanedioic acid and fumaric acid comonomers.

The crystalline resin may be present, for example, in an amount of from about 5 to about 50% by weight of the toner components, but amounts outside of that range can be used. The crystalline resin may possess various melting points of, for example, from about 30° C. to about 120° C. The crystalline resin may have a number average molecular weight ($M_n$) as measured by gel permeation chromatography (GPC) of, for example, from about 1,000 to about 50,000 and a weight average molecular weight ($M_w$) of, for example, from about 2,000 to about 100,000, as determined by GPC. The molecular weight distribution ($M_w/M_n$) of the crystalline resin may be, for example, from about 2 to about 6. The crystalline polyester resins may have an acid value of less than about 1 meq KOH/g, from about 0.5 to about 0.65 meq KOH/g.

Polycondensation catalysts may be utilized in forming either the crystalline or amorphous polyesters and include tetraalkyl titanates, dialkyltin oxides, such as, dibutyltin oxide, tetraalkyltins, such as, dibutyltin dilaurate, and dialkyltin oxide hydroxides, such as, butyltin oxide hydroxide, aluminum alkoxides, alkyl zinc, dialkyl zinc, zinc oxide, stannous oxide, or combinations thereof. Such catalysts may be utilized in amounts of, for example, from about 0.01 mole % to about 5 mole %, based on the starting diacid or diester used to generate the polyester resin.

Examples of diacid or diesters selected for the preparation of amorphous polyesters include dicarboxylic acids or diesters selected from the group consisting of terephthalic acid, phthalic acid, isophthalic acid, fumaric acid, maleic acid, itaconic acid, succinic acid, succinic anhydride and mixtures thereof. The organic diacid or diester can be selected, for example, from about 45 to about 52 mole % of the resin, although amounts outside of that range can be used.

Examples of diols utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, and mixtures thereof. The amount of organic diol selected may vary, and more specifically, is, for example, from about 45 to about 52 mole % of the resin, although amounts outside of that range can be used.

Suitable amorphous polyester resins include, but are not limited to, poly(propoxylated bisphenol co-fumarate), poly (ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate) and combinations thereof.

In embodiments, a suitable amorphous resin utilized in a toner of the present disclosure may be a low molecular weight amorphous resin, sometimes referred to, in embodiments, as an oligomer, having an $M_w$ of from about 500 daltons to about 15,000 daltons. The amorphous resin may possess a $T_g$ of from about 58.5° C. to about 66° C. The low molecular weight amorphous resin may possess a softening point of from about 105° C. to about 118° C. The amorphous polyester resins may have an acid value of from about 8 to about 20 meq KOH/g.

In other embodiments, an amorphous resin utilized in forming a toner of the present disclosure may be a high molecular weight amorphous resin. The high molecular weight amorphous polyester resin may have, for example, an $M_n$, for example, from about 1,000 to about 10,000. The $M_w$ of the resin can be greater than 45,000. The polydispersity index (PD), equivalent to the molecular weight distribution, can be above about 4. The high molecular weight amorphous polyester resins, which are available from a number of sources, may possess various melting points of, for example, from about 30° C. to about 140° C. High molecular weight amorphous resins may possess a $T_g$ of from about 53° C. to about 58° C.

One, two or more resins or latexes may be used. In embodiments, the resin may be an amorphous resin or a mixture of amorphous resins and the temperature may be above the $T_g$ of the mixture. In embodiments, where two or more resins are used, the resins may be in any suitable ratio (e.g., weight ratio) such as, for instance, of from about 1% (first resin)/99% (second resin) to about 99% (first resin)/1% (second resin).

Branching agents for use in forming branched polyesters include, for example, a multivalent polyacid, such as, 1,2,4-benzene-tricarboxylic acid, 1,2,4-cyclohexanetricarboxylic acid, 2,5,7-naphthalenetricarboxylic acid, 1,2,4-naphthalenetricarboxylic acid, 1,2,5-hexanetricarboxylic acid, 1,3-dicarboxyl-2-methyl-2-methylene-carboxylpropane, acid anhydrides thereof, and lower alkyl esters thereof, 1 to about 6 carbon atoms; a multivalent polyol, such as, sorbitol, 1,2,3,6-hexanetetrol, 1,4-sorbitane, pentaerythritol, dipentaerythritol, tripentaerythritol, sucrose, 1,2,4-butanetriol, mixtures thereof, and the like. The branching agent amount selected is, for example, from about 0.1 to about 5 mole % of the resin. As used herein, the terms, "branched," or, "branching," include branched resins and/or cross-linked resins.

Linear or branched unsaturated polyesters selected for reactions include both saturated and unsaturated diacids (or anhydrides) and dihydric alcohols (glycols or diols). The resulting unsaturated polyesters are reactive (for example, crosslinkable) on two fronts: (i) unsaturation sites (double bonds) along the polyester chain, and (ii) functional groups, such as, carboxyl, hydroxy and similar groups amenable to acid-base reaction. Unsaturated polyester resins may be prepared by melt polycondensation or other polymerization processes using diacids and/or anhydrides and diols. Illustrative examples of unsaturated polyesters may include any of various polyesters, such as SPAR™ (Dixie Chemicals), BECKOSOL™ (Reichhold Inc), ARAKOTE™ (Ciba-Geigy Corporation), HETRON™ (Ashland Chemical), PARAPLEX™ (Rohm & Hass), POLYLITE™ (Reichhold Inc), PLASTHALL™ (Rohm & Hass), mixtures thereof and the like. The resins may also be functionalized, such as, carboxylated, sulfonated or the like, such as, sodio sulfonated.

In embodiments, colorants may be added to the resin mixture to adjust or to change the color of the resulting toner. In embodiments, colorants utilized to form toner compositions may be in dispersions. Various known suitable colorants, such as, dyes, pigments, mixtures of dyes, mixtures of pigments, mixtures of dyes and pigments, and the like, may be included in the toner. The colorant may be added in amounts from 0 to about 35 wt %, or more, of the toner.

As examples of suitable colorants, mention may be made of $TiO_2$; carbon black like REGAL 330® and NIPEX® 35; magnetites, such as Mobay magnetites MO8029™, MO8060™; Columbian magnetites; MAPICO BLACKS™ and surface-treated magnetites; Pfizer magnetites CB4799™, CBS300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there may be selected cyan, magenta, yellow, orange, red, green, brown, blue or mixtures thereof. The pigment or pigments can be used as water-based pigment dispersions.

Solvents may be added in the formation of the latexes, for example, to permit reorientation of chain ends to stabilize and to form particles which lead to the formation of stable latexes without surfactant. In embodiments, solvents sometimes referred to, as phase inversion agents, may be used to form the latex. The solvents may include, for example, acetone, toluene, tetrahydrofuran, methyl ethyl ketone, dichioromethane, combinations thereof and the like.

In embodiments, a solvent may be utilized in an amount of, for example, from about 1 wt % to about 25 wt % of the resin. In embodiments, an emulsion formed in accordance with the present disclosure may also include water, in embodiments, de-ionized water (DIW), in amounts from about 30% to about 95%, at temperatures that melt or soften the resin, from about 20° C. to about 120° C.

The particle size of the emulsion may be from about 50 nm to about 300 nm.

In embodiments, a surfactant may be added to the resin, and to an optional colorant to form emulsions. One, two or more surfactants can be used. The surfactants may be selected from ionic surfactants and nonionic surfactants. Anionic surfactants and cationic surfactants are encompassed by the term, "ionic surfactants." In embodiments, the surfactant may be added as a solid or as a solution with a concentration from about 5% to about 100, (pure surfactant) by weight. In embodiments, the surfactant may be utilized so that it is present in an amount from about 0.01 wt % to about 20 wt % of the resin. Combinations of the surfactants may be utilized in embodiments.

Optionally, a wax may be combined with the resin in forming toner particles. The wax may be provided in a wax dispersion, which may include a single type of wax or a mixture of two or more different waxes. Wax may be added to toner formulations, for example, to improve particular toner properties, such as, toner particle shape, presence and amount of wax on the toner particle surface, charging and/or fusing characteristics, gloss, stripping, offset properties and the like. Alternatively, a combination of waxes may be added to provide multiple properties to the toner composition. When included, the wax may be present in an amount of, for example, from about 1 wt % to about 25 wt % of the toner particles.

Optionally, a coagulant or aggregating agent may also be combined with the resin, optional colorant and a wax in forming toner particles. Such coagulants (aggregation agents) may be incorporated into the toner particles during particle aggregation. The coagulant may be present in the toner particles, exclusive of external additives and on a dry weight basis, in an amount of, for example, from about 0.01 wt % to about 5 wt % of the toner particles.

Coagulants that may be used include, for example, an ionic coagulant, such as, a cationic coagulant. Inorganic cationic coagulants include metal salts, for example, aluminum sulfate, magnesium sulfate, zinc sulfate and the like. Examples of organic cationic coagulants may include, for example, dialkyl benzenealkyl ammonium chloride, lauryl trimethyl ammonium chloride, combinations thereof and the like. Other suitable coagulants may include, a monovalent metal coagulant, a divalent metal coagulant, a polyion coagulant or the like. As used herein, "polyion coagulant," refers to a coagulant that is a salt or oxide, such as a metal salt or metal oxide, formed from a metal species having a valence of at least 3. Suitable coagulants thus, may include, for example, coagulants based on aluminum salts, such as, aluminum sulfate and aluminum chlorides, polyaluminum halides, such as, polyaluminum fluoride and polyaluminum chloride (PAC), polyaluminum silicates, such as, polyaluminum sulfosilicate (PASS), polyaluminum hydroxide, polyaluminum phosphate, combinations thereof and the like. Other suitable coagulants may also include, but are not limited to, tetraalkyl titinates, dialkyltin oxide, tetraalkyltin oxide hydroxide, dialkyltin oxide hydroxide, aluminum alkoxides, combinations thereof and the like. Where the coagulant is a polyion coagulant, the coagulants may have any desired number of polyion atoms present. For example, in embodiments, suitable polyaluminum compounds may have from about 2 to about 13 aluminum ions present in the compound.

The aggregating agent or coagulant may be added to the mixture utilized to form a toner in an amount of, for example, from about 0.1 to about 10 wt % of the resin in the mixture.

As known in the art, toner particles may also contain other optional reagents, as desired or required. For example, the toner may include positive or negative charge control agents, for example in an amount from about 0.1 to about 10 wt % of the toner. Examples of suitable charge control agents include quaternary ammonium compounds inclusive of alkyl pyridinium halides; bisulfates; alkyl pyridinium compounds, including those disclosed in U.S. Pat. No. 4,298,672, the disclosure of which hereby is incorporated by reference in entirety; organic sulfate and sulfonate compositions, including those disclosed in U.S. Pat. No. 4,338,390, the disclosure of which hereby is incorporated by reference in entirety; combinations thereof and the like. Such charge control agents may be applied prior to addition of the shell resin described above or after application of the shell resin.

There may also be blended with the toner particles, external additive particles after formation, including, flow aid additives, which additives may be present on the surface of the toner particles. Examples of the additives include metal oxides, such as, titanium oxide, silicon oxide, aluminum oxides, cerium oxides, tin oxide, mixtures thereof and the like; colloidal and amorphous silicas, such as, AEROSIL®, metal salts and metal salts of fatty acids inclusive of zinc stearate, calcium stearate and the like, long chain alcohols, such as, UNILIN 700, and mixtures thereof.

External additives may be present in an amount from about 0.1 wt % to about 5 wt % of the toner. In embodiments, the toners may include, for example, from about 0.1 wt % to about 5 wt % titania, from about 0.1 wt % to about 8 wt % silica, from about 0.1 wt % to about 4 wt % zinc stearate.

Suitable additives include those disclosed in U.S. Pat. Nos. 3,590,000 and 6,214,507, the disclosure of each of which hereby is incorporated by reference in entirety. The additives may be applied prior to addition of the shell resin as described above or after application of the shell resin.

Thus, in embodiments, a process of the present disclosure includes contacting at least one resin, for example, with a surfactant to form a resin mixture, emulsion or dispersion (which terms are used interchangeably herein as describing particulates suspended in a liquid) contacting the resin mixture with a dispersion, emulsion or solution of an optional pigment, optional surfactant and water to form a latex emulsion. In embodiments, a low molecular weight amorphous resin emulsion, a high molecular weight amorphous resin emulsion and a crystalline resin emulsion are used.

DIW may be added to form a latex emulsion with a solids content of from about 5% to about 50%. While higher water temperatures may accelerate the dissolution process, latexes may be formed at temperatures as low as RT. In embodiments, water temperatures may be from about 40° C. to about 110° C.

Stirring, although not necessary, may be utilized to enhance formation of the latex or the mixture of components comprising a toner. Any suitable stirring device may be utilized. In embodiments, the stirring may be at a speed from about 10 revolutions per minute (rpm) to about 5,000 rpm. The stirring need not be at a constant speed and may be varied.

In embodiments, a homogenizer (that is, a high shear device), may be utilized to form or to assist in forming the emulsion. Hence, for example, optionally, a homogenizer may accept the mixed toner ingredients to mix further the reagents for forming a toner particle. The homogenized mixture then can be passed to a twin screw extruder of interest. A homogenizer may operate at a rate from about 3,000 rpm to about 10,000 rpm.

The pH of the mixtures may be adjusted by an acid, such as, for example, acetic acid, sulfuric acid, hydrochloric acid, citric acid, trifluro acetic acid, succinic acid, salicylic acid, nitric acid or the like. In embodiments, the pH of the mixture may be adjusted to about 3.8, about 3.9, about 4.0, about 4.2, about 4.4, from about 2 to about 5, from about 3 to about 4.5, from about 4 to about 4.4. In embodiments, the pH can be adjusted utilizing an acid or a base in a diluted form of from about 0.5 to about 10 wt % by weight of water.

The particles are permitted to aggregate until a predetermined desired particle size is obtained. Samples may be taken during the growth process and analyzed, for example with a COULTER COUNTER, for average particle size. The aggregation may proceed by ramping and maintaining the temperature to, for example, from about 35° C. to about 55° C.

Addition of coagulant or aggregating agent at particular mixture temperatures can bear a direct correlation to particle size, essentially, the cooler the reaction temperature, the smaller the particles.

Once the desired size of the toner particles is achieved, the pH of the mixture may be adjusted with a base from about 3 to about 10, from about 5 to about 9, from about 6 to about 8 to stop or to freeze aggregation. The base utilized to stop toner growth may include any suitable base such as, for example, alkali metal hydroxides such as, for example, sodium hydroxide, potassium hydroxide, ammonium hydroxide, combinations thereof and the like. Alternatively, a basic buffer can be used to raise the pH.

In embodiments, a freezing agent, such as, a chelator, such as, ethylenediamine tetraacetic acid (EDTA), can be used to facilitate cessation of particle growth.

In embodiments, after aggregation, but prior to freeze, a shell may be formed on the aggregated particles. Any resin described above as suitable for forming the core resin may be utilized to form the shell. In embodiments, an amorphous polyester resin as described above may be included to form the shell. Multiple resins may be utilized in any suitable amounts.

In embodiments, the resins utilized to form the shell may be in an emulsion including any surfactant and/or colorant described above. The emulsion possessing the resins may be combined with the aggregated particles described above so that the shell forms over the aggregated particles.

Formation of the shell over the aggregated particles may occur while heating to a temperature of from about 35° C. to about 50° C., from about 37° C. to about 47° C., from about 40° C. to about 46° C.

Coalescence to the desired final shape can be achieved by, for example, heating the mixture to a temperature from about 70° C. to about 95° C., which may be at or above the $T_g$ of the resins utilized to form the toner particles. The coalesced particles may be measured for shape factor or circularity, such as with a Sysmex FPIA 2100 or Sysmex 3000 analyzer, until the desired shape is achieved. Circularity of the particles can be at least about 0.965, at least about 0.970, at least about 0.975 or greater.

After coalescence, the mixture may be cooled to room temperature, such as from about 20° C. to about 25° C. to quench or to stop further particle sizing. The cooling may be rapid or slow, as desired. A suitable cooling method may include introducing cold water to a jacket around the downstream portion of the extruder or a reservoir for the particles released from the extruder. In embodiments, the continuous reactor outflow can be directed or dispensed into a heat exchanger to quench the coalescing toner particles, which may be cooled near or at room temperature, for example. In embodiments, the toner slurry is discharged into a cooled water bath.

After cooling, the toner particles optionally may be sized or particles of desired size can be selected, for example, by sieving coarse and/or fine particles from the slurry, the resulting particles can be washed with water, and then dried. Drying may be accomplished by any suitable method for drying including, for example, freeze drying, flash drying or toroidal drying.

The coarse content of the latex of the present disclosure may be from about 0.01 wt % to about 5 wt %, from about 0.02 wt % to about 4.5 wt %, from about 0.05 wt % to about 4.0 wt %. The solids content of the latex of the present disclosure may be from about 5 wt % to about 50 wt %. In embodiments, the molecular weight of the resin emulsion particles of the present disclosure may be from about 18,000 grams/mole to about 26,000 grams/mole.

For the purposes herein, a, "coarse particle," is one which is at least about 20% larger than the mean particle size of the population, at least about 30% larger, at least about 40% larger and so on.

In embodiments, toner production can be in batch or can be continuous. When continuous, any suitable device can be used. For example, a screw extruder device can be used. The assembly or apparatus that can be used generally comprises parts and components known in the art, and reference can be made to the teachings of U.S. Pat. Nos. 7,459,258 and 7,572,567; and U.S. Publ. No. 2008/0138738, herein incorporated by reference in entirety. However, any design of a twin screw extruder reactor can be practiced. Examples of commercially available devices are a twin screw extruder available from Farrel Corporation, Ansonia, Conn.; Century Inc., Traverse City, Mich.; Coperion Corp., Ramsey, N.J., for example. The screws can corotate, counterrotate, intermesh or not.

The device of interest can comprise a single twin screw extruder, for example, comprising different functional zones as taught herein, for example, a zone for aggregation of toner particles, one for freezing of aggregation, one for coalescence of aggregated particles, one for quenching of coalescence and so on. In other embodiments, the device of interest comprises plural twin screw extruders connected in series to provide a continuous unidirectional flow of fluid through the plural devices wherein one or more functional zones are partitioned consecutively between or among the plural twin screw extruders. For example, aggregation can occur in a first extruder and coalescence can occur in a second extruder.

Along the length of the extruder are ports or sites for reagent addition, for example, addition of acid or base to alter pH, addition of resin to form a shell, addition of aggregating agent, addition of freezing agent, addition of surfactant and so on; for access of a detecting or monitoring device to the slurry contained within the extruder, as well as of heating and cooling elements, for example, for thermocouples or other devices to measure temperature, devices to determine pH, devices to determine particle circularity, devices to obtain a sample of toner and the like; and so on. The coordinated activities of monitoring and action, for example, reagent addition, heating or cooling, real time by the integrated device or devices provide the suitable reactants and reaction conditions along the length of the twin screw extruder(s) to obtain the various steps of toner particle development.

Tubing, lines, conduits and other connections, transporting devices or communication devices used to transport reagents to the extruder and toner from the extruder are standard and available commercially.

The continuous reaction can be conducted under an atmosphere of inert gas (such as nitrogen or argon) so as to minimize or to preclude reactant degradation, maintain toner particle integrity or to control reaction conditions. An entry port on the extruder can be used to introduce the inert gas, and a port can be used to house a detecting portion of a pressure meter or sensor.

Reagents can be introduced into the continuous reactor using, for example, pumps, valves and the like suitably located at ports situated along the flow path of the extruder which enable graded or metered introduction of reactants and which maintain the reaction environment, such as, suitable or desired fluid flow through the continuous reactor, to enable toner formation.

The screw extruder apparatus can comprise functional zones where various operations of toner development occur, such as, a zone where aggregation takes place and a zone where coalescence takes place or using tandem extruders where one extruder is for aggregation, shell addition and particle freezing, and the other extruder is for particle coalescence, for example. Each zone can comprise, for example, a pH meter, a thermocouple or temperature sensing device and one or more ports for adding buffer, acid or base to control pH, for adding one or more reagents and so on. Material within the extruder moves from the upstream site where the toner mixture is added to the device in the downstream direction sequentially through the zones along the length or flow path of the extruder(s), eventually passing from the extruder into a site for collecting, optionally, sizing, washing and/or drying toner particles.

The screws can be modular in the form of pieces of elements, enabling the screw to be configured with different conveying elements and agitating elements having the appropriate lengths, thread angles and the like, in such a way as to provide optimum conveying, mixing, dispersing, discharging and pumping functions, for example, for each functional zone or each separate component or extruder. Hence, the overall shape of the screw elements, screw depth, helix angles and the like can be configured as a design choice.

The local residence time in the zones can be controlled by screw design, screw speed, feed rates, temperature and pressure. The local residence time suitable for aggregation/coalescence can vary depending on a number of factors including, for example, the particular latex employed, the temperature within the barrel and the particular aggregation agent, the flow speed of the fluid or slurry and so on.

The term, "residence time," refers to the internal volume of the reaction zone within the apparatus occupied by the reactant fluid flowing through the space divided by the average volumetric flow rate for the fluid flowing through the space, at the temperature and pressure being used.

As taught herein, the temperature of the liquid in the flow path is controlled by various temperature sensing and control devices, such as, a thermocouple, a heating coil, a jacket and so on to produce a controlled temperature regimen along the length of the flow path. Multiple temperature control devices can be placed along the flow path length so that defined temperature profiles are obtained along the length of the flow path. Thus, temperature can remain constant throughout the flow path; continuously increase along the length of the flow path; increase at the input of the mixture to the reactor, but only for that portion of the reactor, which may comprise one half of the flow path, one third of the flow path and so on as a design choice, with no further heating to enable the fluid contents to cool at a defined temperature erosion rate through the remainder of the flow path; may be designed to increase to a defined temperature, remain at that temperature for a defined length of flow path, and then heated further or cooled to a defined lower temperature to provide a particularly designed temperature profile along the length of the flow path and so on.

Similarly, the pH profile along the length of the extruder is maintained and controlled in the same fashion by measuring and addition of acid, base or buffer as needed to obtain the desired pH at the particular site of the flow path.

The components for making toner are contributed by individual reservoirs in automated fashion, for example, using a meter or a pump to a common receptacle, and there, are well mixed and optionally homogenized to form a uniform mixture, suspension, emulsion, solution etc. The reagents are those that will form the primitive toner particle, such as, one or more resins, optional wax(es), optional colorant(s), optional surfactant(s) and so on. The pH of the mixture prior to adding to the extruder or just after the mixture is added to the extruder is adjusted to about 4.0, about 4.1, about 3.9, about 4.2, about 3.8 to induce particle growth.

As aggregation ensues as the mixture is transported down the flow path within the extruder, the pH is monitored to ensure to be about 4.0, and appropriate acid, base or buffer is added as needed to control pH. The temperature on entry of the mixture in the extruder is elevated to no more than about 480, no more than about 47°, no more than about 46°, no more than about 45°. When the particles attain a desired size, an optional shell resin can be added. An optional surfactant can be introduced. Coalescence is triggered by raising the pH to about 7.4, about 7.5, about 7.6, about 7.7, about 7.8, about 7.9. The reaction temperature is ramped to about 82° C., about 83° C., about 84° C., about 85° C., about 86° C., about 87° C.

After coalescence is completed, the desired particles are expelled from the extruder into a receptacle where coalescence can be halted, generally, by a reduction in temperature, such as, a jacketed receptacle, a heat exchanger, dispersing the toner in a volume of water and so on.

The toner particles can be coursed through a filter or a sieve to separate particles of undesired size, such as, passing the slurry through a wet sieving device to separate undesired, for example, coarse particles, from the toner particle slurry.

The sized toner particle slurry then can be passed to a washing system such as continuous drum filter arrangement of liquid or a cross-flow filtration system to separate the mother liquor or fluids from the particulates as well as washing the particles. The toner particles can be washed, for example, with DIW. The washing system can reduce fluid volume.

The washed toner particle slurry then are dried practicing methods known in the art. For example, the washed particles can be directed to, for example, a spray dryer. Optionally, the partially dried particles can be passed to another form of drier, such as, a toroidal dryer.

The resulting toner particles can be no greater than about 4 μm in diameter, no greater than about 4.5 μm in diameter, no greater than about 5 μm in diameter, no greater than about 5.5 μm in diameter.

Any of a number of additives can be added to the toner particles to impart selected desired properties on and to the toner surface. For example, suitable surface additives that may be used are one or more of $SiO_2$, metal oxides such as, for example, cerium oxide, $TiO_2$, aluminum oxide, polymethyl methacrylate (PMMA) and a lubricating agent such as, for example, a metal salt of a fatty acid (for example, zinc stearate (ZnSt), calcium stearate) or long chain alcohols, such as, UNILIN 700. $SiO_2$ and $TiO_2$ may be surface-treated with compounds including DIMS (dodecyltrimethoxysilane) or HMDS (hexamethyldisilazane). Examples of additives are a silica coated with a mixture of HMDS and aminopropyltriethoxysilane; a silica coated with PDMS (polydimethylsiloxane); a silica coated with octamethylcyclotetrasiloxane; a silica coated with dimethyldichlorosilane; a silica coated with an amino functionalized organopolysiloxane and so on. DTMS silica, obtained from Cabot Corporation, is comprised of a fumed silica, for example, silicon dioxide coated with DTMS.

Zinc stearate also may be used as an external additive. Calcium stearate and magnesium stearate may provide similar functions. Zinc stearate may have an average primary particle size in the range of, for example, from about 500 nm to about 700 nm, such as, from about 500 nm to about 600 nm or from about 550 nm to about 650 nm.

Others additives may include titania comprised of a crystalline titanium dioxide core coated with DTMS and titania comprised of a crystalline titanium dioxide core coated with DTMS. The titania also may be untreated, for example, P-25 from Nippon AEROSIL Co., Ltd. Zinc stearate also may be used as an external additive, the zinc stearate providing lubricating properties. Zinc stearate provides developer conductivity and tribo enhancement, both due to the lubricating nature thereof. In addition, zinc stearate may enable higher toner charge and charge stability by increasing the number of contacts between toner and carrier particles. Calcium stearate and magnesium stearate provide similar functions.

In embodiments, the toner particles may be mixed with one or more of silicon dioxide or silica ($SiO_2$), titania or titanium dioxide ($TiO_2$) and/or cerium oxide. In embodiments, a silica, a titania and a cerium are present. Silica may have an average primary particle size, measured in diameter, in the range of, for example, from about 5 nm to about 50 nm, such as, from about 10 nm to about 40 nm or from about 20 nm to about 30 nm. The silica may have an average primary particle size, measured in diameter, in the range of, for example, from about 100 nm to about 200 nm, such as, from about 110 nm to about 150 nm or from about 125 nm to about 145 nm. The titania may have an average primary particle size in the range of, for example, about 5 nm to about 50 nm, such as, from about 7 nm to about 40 nm or from about 10 nm to about 30 nm. The cerium oxide may have an average primary particle size in the range of, for example, about 5 nm to about 50 nm, such as, from about 7 nm to about 40 nm or from about 10 nm to about 30 nm.

Surface additives may be used in an amount of from about 0.1 to about 10 wt %, from about 0.25 to about 8.5 wt %, from about 0.5 to about 7 wt % of the toner.

In embodiments, an additive package may contain one or more additives which exhibit low dielectric loss, wherein the primary particles size of said one or more additives is greater than about 30 nm, is greater than about 40 nm, is greater than about 50 nm, is greater than about 60 nm, and wherein said toner exhibits high pigment loading at reduced toner mass per unit area (TMA).

In embodiments, an additive package may include, for example, with representative and non-limiting amounts as a percentage of the total toner weight in parentheses, AEROSIL® RY50L (a silica surface treated with polydimethylsiloxanes, Evonik) (1.29%), fumed silica surface treated with HMDS, AEROSIL® RX50 (Evonik) (0.86%), silica TG-C190 (Cabot) (1.66%), titanium surface treated with isobutyltrimethoxysilane (STT100H) (Titan Kogyo) (0.88%), cerium dioxide, E10 (Mitsui Mining and Smelting) (0.275%), ZnPF, a zinc stearate (NOF) (0.18%) and polymethylmethacarylate (PMMA) fines (MP 116CF) (Soken) (0.50%). In embodiments, an additive package can comprise RY50L, RX50, STT100H and PTFE (polytetrafluoroethylene).

In embodiments, the dried toner particles are mixed with a carrier gas (which includes, but is not limited to nitrogen, argon, helium, hydrogen and air), where the carrier gas may be introduced via one of plural ports in the extruder or by a conduit, such as a reaction tube that enters directly into the resonant cavity, the carrier gas-dried toner particles mixture introduced into and is conducted in a reaction tube which is in operable communication with a microwave resonant cavity, where the microwave resonant cavity is in microwave communication with a wave guide. By "microwave communication," is meant the wave guide contains and directs microwaves from a source or generator to the resonant cavity. The actual configuration of the microwave generator is a design choice and the actual means and configuration by which the toner and carrier gas enter the generator and of the generator as described herein is not limiting. Microwaves are generated by a, for example, magnetron, and directed by the wave guide (which may be cylindrical or rectangular), which generation may be at atmospheric pressure at a frequency of from about 1 MGHz to about 300 GHz. The microwaves convert the gas in the reaction tube into a plasma, which is ignited, and the plasma acts on the surface of the dried toner particles activating the surface thereof. The activated toner particles then are exposed to a powder cloud including one or more additives selected from metal oxides, colloidal and amorphous silicas, metal salts and metal salts of fatty acids long chain alcohols, and combinations thereof, that attach to the surface of the activated dried toner particles.

In one aspect, the generation of plasma may be carried out in the absence of heating. In another aspect, the excitation energy supplied to a gas to form a plasma includes electrical discharge, direct current, radio frequency, and microwaves. When other forms of energy are used, the description herein is suitably converted from microwave to whatever form of electromagnetic radiation or other energy source used to generate the plasma. Thus, microwave communication would be, in the case of electric discharge, "electrical discharge communication," which would be an appropriate means to communicate or to exposed the gas to form a plasma.

Suitable devices for generating a plasma are available commercially, such as, those available from PVA TePLA (Corona, Calif.); Siubaura Mechanotronics Corp. (Yokahama, JP); Thierry Plasma (Royal Oak, Mich.); Cober Muegge (Norwalk, Conn.); and so on. The plasma generating device can be configured to be in operable communication with a toner generating device, such as, a batch reactor or a continuous reactor, using a suitable toner communication means, such as, a tube, a tubing, a pipe and so on, alternatively, the plasma generating device can be fed toner directly from a reservoir or holding device, and with a device for introducing one or more additives.

In embodiments, the toner particles carrying one or more additives can be exposed to an elevated temperature, such as, just below the $T_g$ of any resin or additive, by exposing the reaction tube to an energy source, such as, a heating jacket, a tubular reactor and so on so that the contents of the reaction tube are heated. Alternatively, the toner particles can be discharged into an oven or a vessel to obtain such heating of the toner particles, as known in the art.

The resulting toner particles with additives at the surface thereof can be used as a developer or can be combined with a carrier to form a developer. The developer can be used to form images as known in the art.

For example, an extruder was equipped with a feed hopper and screw design as depicted in US Publ. No. 20110286296. A low molecular weight (e.g., 22,000) resin was fed into the extruder as an emulsion in water. Multiple injection ports were used for the device and process, for example, one for adding DOWFAX surfactant solution, another for adding a coagulant, if desired, and others for containing devices for monitoring the slurry within, for example, for temperature and pH.

Through further downstream ports of the extruder, IGI polyethylene wax and NIPEX black colorant were added to the formed and forming resin particles. The extruder temperature and pH were configured to allow particle aggregation and coalescence. The resulting toner particles exit the extruder and were collected at a rate of about 2000 lbs/hr at about 35% solid content with pH between 7-8. The toner particles were washed with deionized water and then dried.

Dried toner particles are placed in a holding vessel in communication with a carrier gas source, such as, air, and in communication with a PVA TePLA plasma generator which can deliver at least 50 GHz of microwave radiation. The device is configured to contain a continuous reaction tube which courses through a microwave chamber where the toner particles are exposed to the microwave radiation which prompts the air to form a plasma, which is ignited in the reaction tube.

About 100 parts of dried toner are transported into the reaction tube using, for example, a blower, at a rate, for example, of 19.8 lbs/hr. The toner particles are moved in the reaction tube into the resonant cavity where the particle/carrier gas mixture is exposed to the microwave radiation to form a plasma. The plasma is ignited and acts at the toner particle surface.

The device is configured so the reaction tube is in communication with a regulatable port for the introduction of one or more additives in the form or a dust, cloud or suspended powder. The holding tank for additives can contain, for example, one or more of AEROSIL® RY50L (Evonik) (1.29%), fumed silica surface treated with HMDS, AEROSIL® RX50 (Evonik) (0.86%), silica TG-C190 (Cabot) (1.66%), titanium surface treated with isobutyltrimethoxysilane (STT100H) (Titan Kogyo) (0.88%), cerium dioxide, E10 (Mitsui Mining and Smelting) (0.275%), ZnPF, a zinc stearate (NOF) (0.18%) and polymethylmethacarylate (PMMA) fines (MP 116CF) (Soken) (0.50%) in relative amounts, and when all are present, for example, the wt % indicated for each additive above can be present in the final toner. In embodiments, an additive package can comprise RY50L, RX50, STT100H and PTFE (polytetrafluoroethylene).

The additives are introduced into the reaction tube containing the activated toner particles at a rate of about 1.133 lbs/hr.

The reaction tube then proceeds to a site comprising a fluid jacket or tubular heating element that enables heating the coated toner particles within the reaction tube to a temperature, such as, below the $T_g$ of the resins and additives, such as, from about 40° C. to about 50° C. Toner particles with the attached additives are obtained.

All references cited herein are herein incorporated by reference in entirety.

It will be appreciated that various of the above-disclosed and other features and functions, or alternatives thereof, may be desirably combined into many other different systems or applications. Also various presently unforeseen or unanticipated alternatives, modifications, variations or improvements therein may be subsequently made by those skilled in the art, which are also intended to be encompassed by the following claims. Unless specifically recited in a claim, steps or components of claims should not be implied or imported from the specification or any other claims as to any particular order, number, position, size, shape, angle, color or material.

We claim:

1. A method of attaching one or more additives to a toner particle surface comprising:

conducting a carrier gas comprising toner particles into a reaction tube which is in communication with a microwave resonant cavity, wherein said microwave resonant cavity is in microwave with a wave guide;

conducting plasma-inducing microwaves in said wave guide to said cavity; generating carrier gas plasma in said reaction tube in said microwave resonant cavity, wherein said toner particles are exposed to said carrier gas plasma;

igniting said exposed plasma, wherein said ignited plasma activates toner particle surfaces;

exposing said activated toner particles to a powder cloud comprising one or more additives, wherein said one or more additives attach to the surface of the activated toner particles and wherein the one or more additives are external additives; and exposing said toner particles comprising additives to an elevated temperature to produce toner particles comprising additives at the surface thereof.

2. The method of claim 1, wherein the one or more additives are selected from the group consisting of metal oxides, colloidal and amorphous silicas, metal salts and metal salts of fatty acids long chain alcohols, and combinations thereof.

3. The method of claim 1, wherein the waveguide is cylindrical or rectangular.

4. The method of claim 1, wherein the plasma is generated with a frequency of from about 1 MGHz to about 300 GHz.

5. The method of claim 1, wherein the carrier gas is selected from the group consisting of nitrogen, argon, helium, hydrogen and air.

6. The method of claim 1, wherein the toner particles are made by emulsion aggregation.

7. The method of claim 1, wherein the toner particles comprise a resin comprised of styrenes, acrylates, polyesters or combinations thereof.

8. The method of claim 1, wherein the toner particles comprise a resin comprised of a crystalline polyester resin, an amorphous polyester resin, or combinations thereof.

9. The method of claim 1, wherein the toner particles comprise an optional wax and an optional colorant.

10. The method of claim 1, wherein the additives of the resulting toner particles resist falling off or embedding in toner particles as compared to toner particles made without exposure to plasma.

11. A continuous chemical toner process for producing toner particles comprising:

(a) mixing one or more latex resins, an optional colorant, an optional wax and an optional surfactant to produce a toner reaction mixture;

(b) adding said mixture to a twin screw extruder, wherein said extruder comprises plural ports along the length of said extruder for reagent introduction and plural ports along the length of said extruder for reactant monitoring, and wherein movement of said twin screws moves said mixture along the length of said extruder;

(c) adjusting pH of said mixture to about 4;

(d) adding an aggregating agent to said mixture at a pH of about 4;

(e) increasing temperature of said mixture to no more than about 48.degree. C.;

(f) transporting said mixture along the length of said extruder to enable aggregation of particle; optional formation of a shell on said aggregated particle; freezing aggregation of said particles; and coalescence of said aggregated particles to form toner particles;

(g) quenching said toner particles; and optionally adding one or more resins for forming a shell;

(h) sizing said quenched toner particles;

(i) washing said quenched or sized toner particles; or (j) drying said quenched, sized or washed toner particles;

(k) mixing said dried toner particles with a carrier gas in a reaction tube, wherein said carrier gas optionally is introduced via one of said plural ports;

(l) conducting the carrier gas-dried toner particle mixture into a cavity, wherein said cavity is in electrothermal and fluid communication with a wave guide;

(m) conducting a plasma-inducing microwave in said wave guide to said cavity;

(n) generating plasma in said reaction tube, optionally, at atmospheric pressure, wherein said plasma is exposed to the dried toner particles;

(o) igniting the exposed plasma, wherein said ignited plasma activates toner particles surfaces;

(p) conducting the activated dried toner particles to a separate section of the reaction tube and exposing said activated dried toner particles to a powder cloud comprising one or more additives selected from the group consisting of metal oxides, surface treated metal oxides, colloidal and amorphous silicas, metal salts and metal salts of fatty acids long chain alcohols, and combinations thereof, wherein said one or more additives attach to the surface of the activated dried toner particles;

(q) heating said toner particles comprising said one or more additives; and (r) collecting said toner particles comprising one or more additives.

12. The process of claim 11, wherein the generation of plasma is carried out in the absence of heating.

13. The process of claim 11, wherein excitation energy supplied to a gas to form a plasma is selected from the group consisting of electrical discharge, direct current, radio frequency and microwaves.

14. The process of claim 11, wherein the waveguide is cylindrical or rectangular.

15. The process of claim 11, wherein the plasma is generated with a frequency of from about 1 MGHz to about 300 GHz.

16. The process of claim 11, wherein the carrier gas is selected from the group consisting of nitrogen, argon, helium, hydrogen and air.

17. The process of claim 11, wherein the toner particles are made by emulsion aggregation.

18. The process of claim 11, wherein the toner particles comprise a resin comprised of styrenes, acrylates, polyesters or combinations thereof.

19. The process of claim 11, wherein the toner particles comprise a resin comprised of a crystalline polyester resin, an amorphous polyester resin or combinations thereof.

* * * * *